US008181852B2

(12) United States Patent
Saltsov et al.

(10) Patent No.: US 8,181,852 B2
(45) Date of Patent: May 22, 2012

(54) BANKNOTE VALIDATOR WITH BANKNOTE STACK RECEIVER

(75) Inventors: Leon Saltsov, Thornhill (CA); Volodymyr Barchuk, Toronto (CA); Sergiy Androsyuk, Toronto (CA); Oleksandr Soyfer, Vinnitsa (UA); Mykhaylo Bazhenov, Kiev (UA); Olga Bazhenova, legal representative, Kiev (UA); Bogdan Mishunin, Toronto (CA); Oleksandr Onipchenko, Thornhill (CA)

(73) Assignee: Crane Canada Co., Concord, ON (CA)

( * ) Notice: Subject to any disclaimer, the term of this patent is extended or adjusted under 35 U.S.C. 154(b) by 646 days.

(21) Appl. No.: 11/990,594

(22) PCT Filed: Aug. 17, 2006

(86) PCT No.: PCT/CA2006/001349

§ 371 (c)(1),
(2), (4) Date: Jun. 15, 2009

(87) PCT Pub. No.: WO2007/019697

PCT Pub. Date: Feb. 22, 2007

(65) Prior Publication Data

US 2009/0314839 A1 Dec. 24, 2009

(30) Foreign Application Priority Data

Aug. 19, 2005 (CA) ..... 2516555

(51) Int. Cl.
*G07D 11/00* (2006.01)
*G07F 19/00* (2006.01)

(52) U.S. Cl. ..... 235/379

(58) Field of Classification Search ..... 235/375, 235/379; 271/125, 152
See application file for complete search history.

(56) References Cited

U.S. PATENT DOCUMENTS

| | | | | |
|---|---|---|---|---|
| 4,494,747 | A * | 1/1985 | Graef et al. | 271/263 |
| 4,585,125 | A * | 4/1986 | Mori et al. | 209/534 |
| 5,172,900 | A * | 12/1992 | Uno et al. | 271/125 |
| 2003/0178763 | A1 * | 9/2003 | Hiramitsu et al. | 271/152 |

* cited by examiner

*Primary Examiner* — Thien M. Le
*Assistant Examiner* — Christopher Stanford

(57) ABSTRACT

A banknote stack receiving structure is provided in front of a banknote validator for sequentially passing banknotes to the validator in a serial manner. A first drive arrangement engages one side of an exposed banknote and urges the banknote towards the validator. A restrictive drive cooperates with the first drive and a banknote must pass between opposed rollers of the drives to move to the validator. The restrictive drive roller contacts the opposite side of the exposed banknote but may also contact an overlapping banknote. The restrictive drive rotates to feed a banknote to the validator if a single banknote is present and automatically rotates in an opposite direction if overlapping banknotes are present. This automatic direction of rotation is due to slippage between banknotes and overcoming a low torque motor of the restrictive drive when a single banknote is present.

14 Claims, 5 Drawing Sheets

BANKNOTE VALIDATOR WITH BANKNOTE STACK RECEIVER

FIELD OF THE INVENTION

The present invention relates to banknote validators and in particular, relates to banknote validators that are capable of receiving a stack of banknotes and individually feeding the banknotes through the banknote validator.

BACKGROUND OF THE INVENTION

Automated payment terminals and/or automated teller machines typically include a banknote validator which examines the banknotes and provides an assessment of the validity of the banknotes. Certain banknotes are rejected when confirmation of the validity thereof has produced a negative result. Most banknote validators are designed to receive single banknote with the user appropriately feeding a further banknotes in a serial manner. For many applications, this is sufficient, however, there are circumstances where it is desirable to have a user insert a stack of banknotes with the device then feeding the banknotes in series through the validator.

Although the concept of feeding the top or bottom banknote from a banknote stack through a validator is straightforward, in actual practice, it is difficult to provide a device which avoids feeding of overlapped banknotes. As can be appreciated, the quality of the banknotes provided to the device by the user, varies considerably and this substantial variation in the quality presents further design challenges.

The present invention provides a banknote restricting drive which allows a stack of banknotes to be inputted into the device and the banknotes to be serially fed through an associated validator.

SUMMARY OF THE INVENTION

A banknote restricting drive according to the present invention comprises a banknote receiving cavity for receiving a stack of banknotes, a first drive arrangement for engaging an exposed banknote on one side of the stack of banknotes and driving the exposed banknote into a banknote validator section. A banknote restricting drive arrangement cooperates with the first drive arrangement to limit the passage of banknotes therebetween to a single thickness banknote. The banknote restricting device includes a motor providing a low torque rotating the banknote restricting drive in a reverse direction urging a banknote to the receiving cavity when two banknotes attempt to pass between the first drive arrangement and the banknote restricting drive arrangement. The first drive arrangement is driven at a higher torque and provides sufficient force on the exposed banknote such that the exposed banknote overpowers the torque of the banknote restricting drive causing the banknote restricting drive to rotate in a direction to pass the exposed banknote to the validating section. If two banknotes attempt to pass between the first drive and the restricting drive, the banknotes slip relative to each other allowing the restricting drive to automatically rotate to reject the additional banknote.

According to an aspect of the invention, the first drive arrangement and the restricting drive arrangement each have a coefficient of friction with the banknote higher than a coefficient of friction between two banknotes.

In yet a further aspect of the invention, the banknote receiving cavity narrows towards an engagement point of the first drive and the restricting drive arrangement.

In yet a further aspect of the invention, the restricting drive arrangement is directly opposed the first drive arrangement.

In yet a further aspect of the invention, the apparatus includes a sensor arrangement for detecting initial insertion of a stack of banknotes into the banknote receiving cavity and an actuator associated with the sensor arrangement that moves the first drive arrangement to a clear position allowing the insertion of the stack of banknotes into the banknote receiving cavity to a start position. The sensor arrangement senses the position of the stack of banknotes in the start and then causes the actuator to move the first drive arrangement to a banknote engaged position.

In yet a further aspect of the invention, the first drive arrangement includes a lead roller movable between the clear position and the engaged position and at least one downstream roller cooperating with at least one drive roller of the banknote restricting drive arrangement.

In yet a further aspect of the invention, the first drive arrangement includes two downstream rollers and said restricting drive arrangement includes two drive rollers in opposed relationship with the two downstream rollers of the first drive arrangement for separating of overlapped banknotes.

In a different aspect of the invention, the two downstream rollers of the first drive arrangement and the two downstream rollers of the banknote restricting drive arrangement, each includes an outer sleeve of a material having a high coefficient of friction with a banknote.

In a different aspect of the invention, the lead roller of the first drive arrangement is provided on a pivoting arm controlled by the actuator to move between the clear position and the banknote engaged position.

In a preferred aspect of the invention, the pivoting arm includes a spring bias urging the arm to the banknote engaged position.

In yet a further aspect of the invention, the apparatus includes a trailing edge sensor at a discharged position of the banknote restricting drive for sensing the passing of a trailing edge of a banknote from the downstream rollers. The trailing edge sensor temporarily controls the first drive arrangement and temporarily controls the first drive arrangement when the passing of a trailing edge of a banknote is sensed by the trailing edge sensor.

BRIEF DESCRIPTION OF THE DRAWINGS

Preferred embodiments of the invention are shown in the drawings, wherein.

DETAILED DESCRIPTION OF THE PREFERRED EMBODIMENTS

The validator 100 is designed to have a user insert a stack of banknotes indicated as 104 in the banknote receiving cavity 102. The banknotes are fed from the top of the stack 104 individually through the validator where various sensors 130 determine the validity of the individual banknotes.

Figure 5:
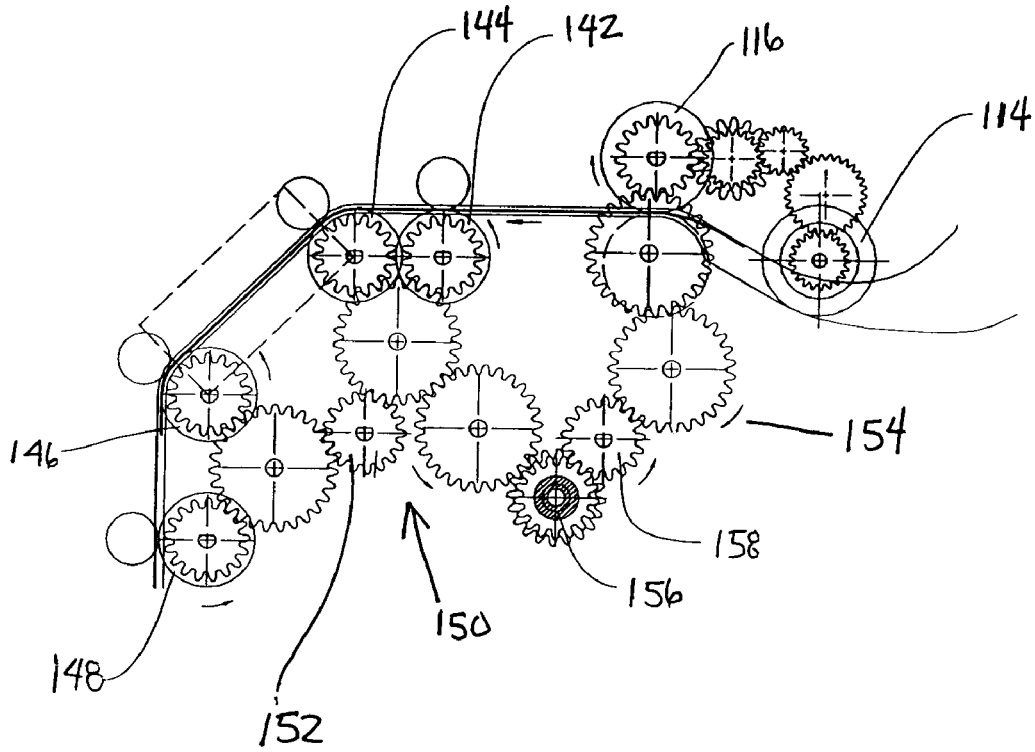
FIG. 5 is a partial schematic view showing a drive train arrangement connecting the validator and the banknote stacked receiving arrangement.
Figure 6:
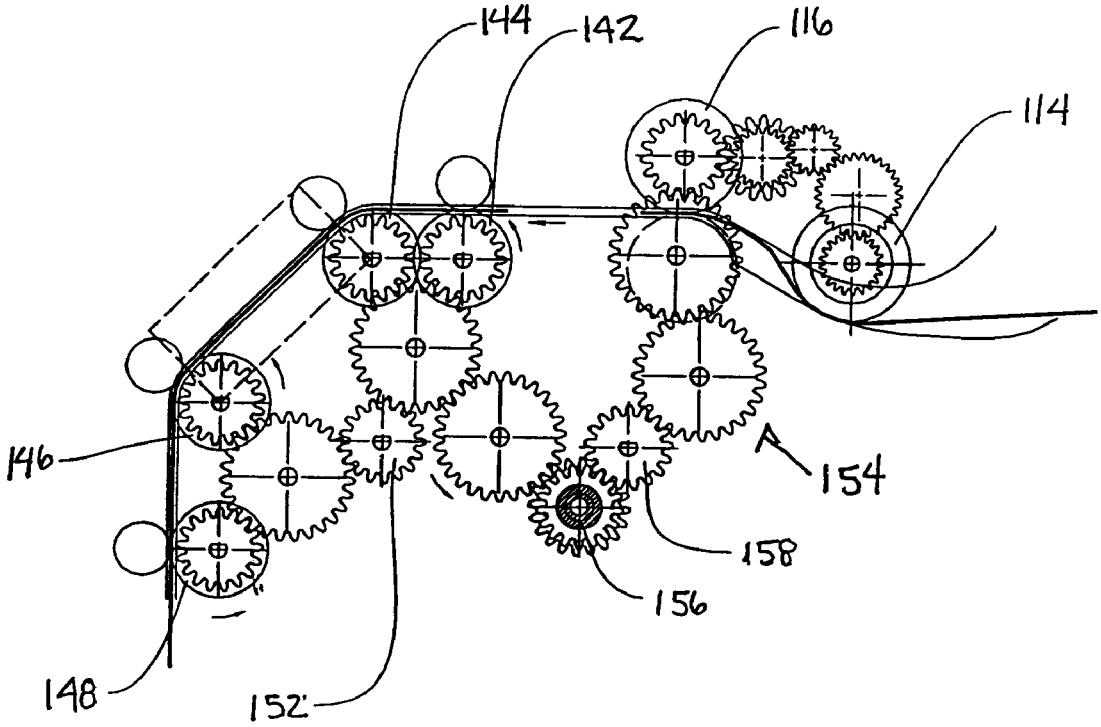
FIG. 6 is a schematic view similar to FIG. 5 with a secondary banknote being held in the banknote receiving arrangement.
Figure 7:
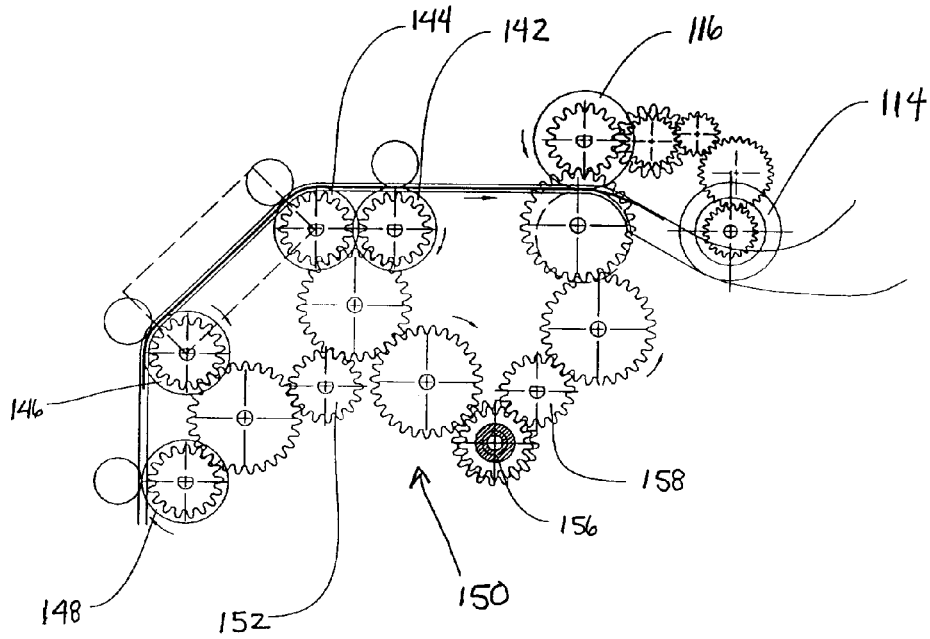
FIG. 7 is a schematic view similar to FIG. 5 showing the rejection of a banknote.

Adjacent the banknote receiving cavity 102 is a first drive arrangement 106 which includes the drive rollers 114 and 116. These drive rollers are interconnected by a drive train as shown in FIGS. 5 through 7.

Figure 3:
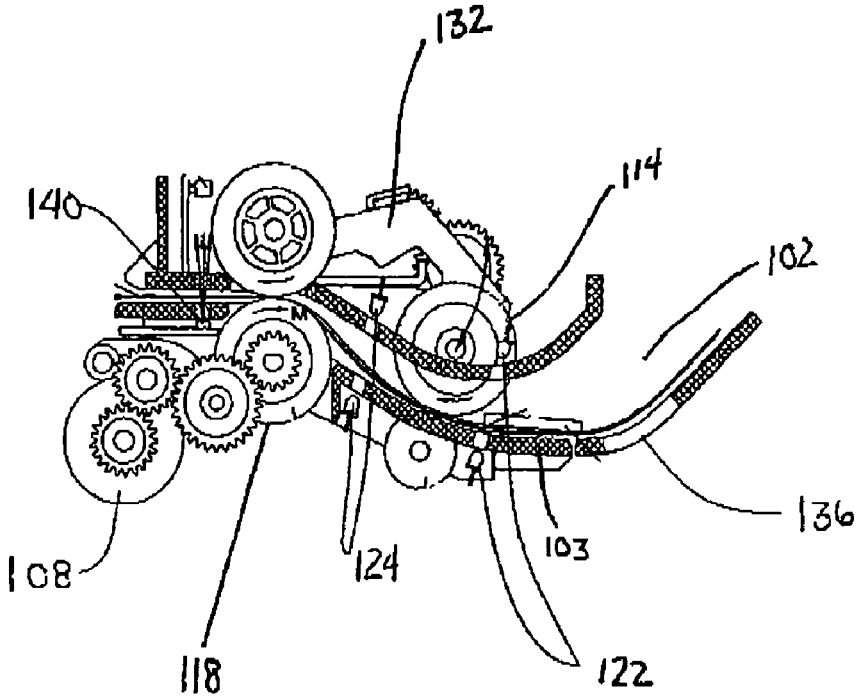
FIG. 3 is a partial schematic showing the banknote stacked receiving arrangement.

The first drive roller 114 as shown in FIG. 3 is connected on the pivoting lever arm 132 allowing movement of the roller between the engaged position of FIG. 3 to a disengaged position where the periphery of roller 114 is generally adjacent the upper surface of the banknote receiving cavity 102. A sensing arrangement 122 is provided immediately downstream of roller 114. In this case, a light emitter is provided to one side of the cavity and a receiver is provided to the opposite side of the cavity. The insertion of the stack of banknotes into the receiving cavity interrupts this signal and the lever arm 132 is moved by the actuator 134 via the linkage 138 to position the roller 114 in a clear position.

A second sensor arrangement 124 is provided immediately in front of the first drive roller 116 and the restricting drive roller 118. Once the stack of banknotes are sensed in this position, the actuator 134 releases the lever arm 132 such that the drive wheel 114 engages the upper banknote due to a spring bias on the lever arm 132. Other arrangements can also be used.

Figure 4:
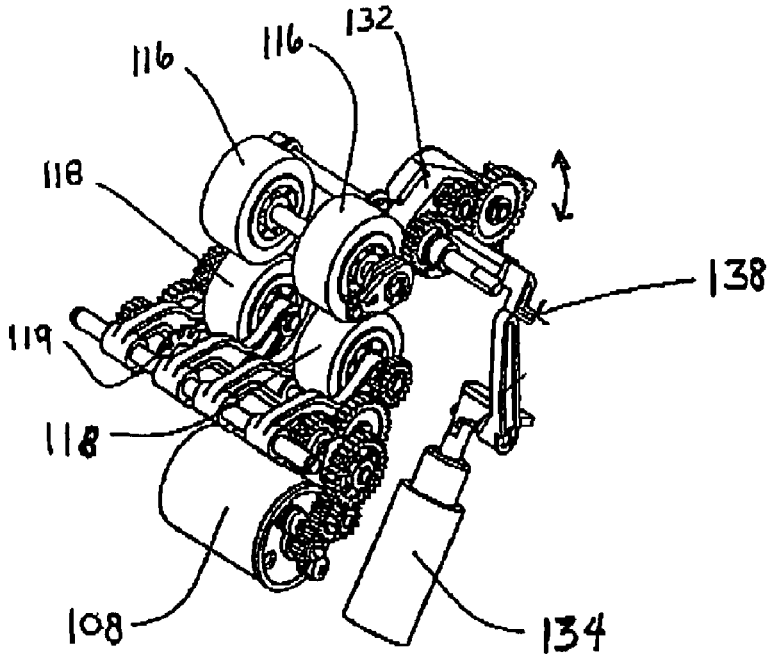
FIG. 4 is a partial perspective view showing certain drive rollers of the banknote stacked receiving arrangement.

Before considering the precise mechanism for providing the series of individual banknotes being fed to the validating section 131, it may be helpful to consider how the individual banknotes are separated from the stack. Basically the first drive rollers 114 and 116 contact the upper most banknote and when driven, these rollers advance the banknote into the pressure gap defined by roller 118 being in contact with roller 116. In the preferred structure as shown in FIG. 4, the rollers 116 and 118 are two pairs of rollers.

Roller 118 is driven by motor 8, however, this is a variable torque motor having a relatively low torque. Drive wheel 118 is urged by motor 8 to rotate in a clockwise direction. Therefore any underlying banknote will be driven to return to the cavity 102. The torque of the low torque motor 8 is adjusted such that the torque is overcome by the force of drive wheel 116 in contact with the drive wheel 118 if a banknote is not present.

In this situation, motor 106 drives drive wheel 116 and it will overpower the torque being applied to drive wheel 118 by motor 8 such that drive wheel 116 and 118 rotate to allow feeding of a banknote therebetween. The motor 8 is designed to withstand the prolonged stalls of the motor that occur when a single banknote passes through the rollers. A high resistance DC brush motor works satisfactorily. If a single banknote is presented to the nip between rollers 116 and 118, roller 118 will continue to rotate in a counterclockwise direction with the intermediate banknote providing the component for transferring the force between roller 116 and 118. Basically the coefficient of friction of roller 116 to a banknote and the coefficient of friction between the banknote and roller 118 are relatively high and overcome the torque being applied by motor 8. If two banknotes are presented to the gap between roller 116 and 118, roller 118 will rotate in the opposite direction. Basically the coefficient of friction between the two banknotes is much lower and therefore drive roller 118 will rotate clockwise and thereby return the lower banknote to the banknote cavity. Thus if two or more banknotes are provided to the gap, roller 118 will rotate clockwise and will reject these banknotes. Once a single banknote is in the gap, roller 118 will then automatically rotate counterclockwise. This particular arrangement has proven effective for limiting the passage of the banknotes between rollers 116 and 118 to banknotes in series. Preferably the motor 108 includes a torque adjustment arrangement to ensure that the torque being applied to roller 118 is low enough to be overcome by roller 116 under changing conditions.

Figure 1:
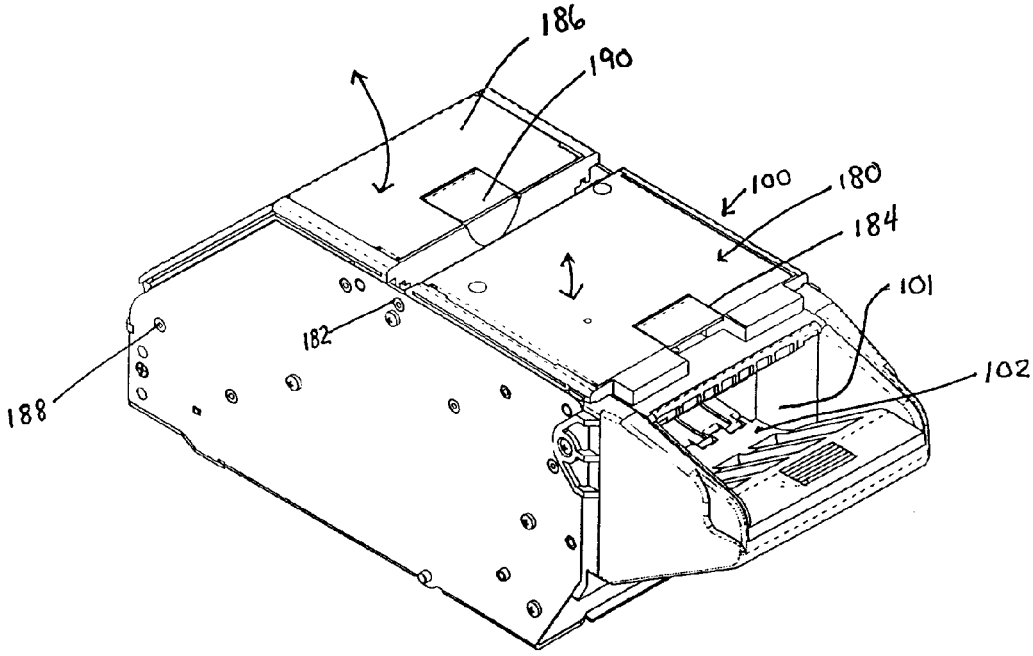
FIG. 1 is a perspective view of the validator with a banknote stacked receiving arrangement.
Figure 2:
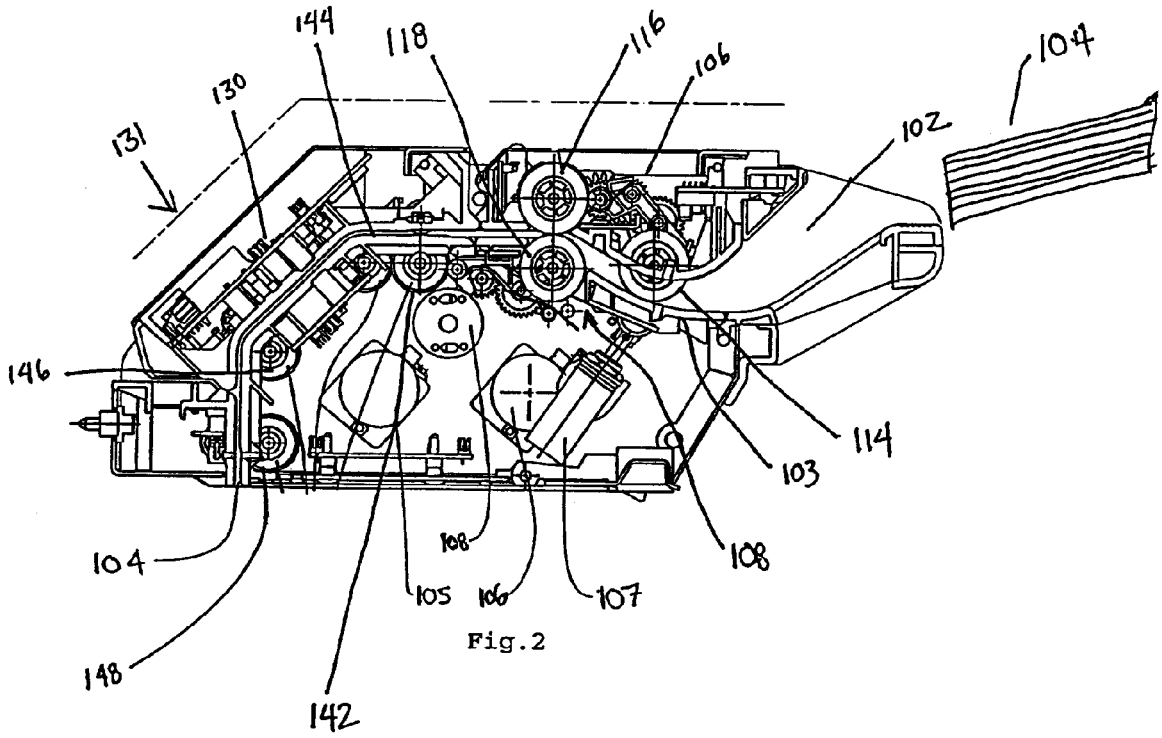
FIG. 2 is a sectional view of the validator with a banknote stacked receiving arrangement.

With the embodiment as shown in FIG. 2, movement of roller 114 to the clear position allows the banknote stack 104 to be inserted into the downwardly inclined cavity 102 to meet with the curved transition segment 103 and pass upwardly towards the drive rollers 116 and 118. It can be seen that roller 118 basically interrupts the passage and acts as a partial stop for the stack of banknotes. Once sensors 124 senses the stack of banknotes, roller 114 is moved to the engaged position.

FIG. 3 shows a further aspect of the invention where the banknote receiving cavity 102 has been provided with a series of ports 136 to allow coins, dirt, liquid, etc. to pass through the receiving cavity.

FIG. 3 also illustrates a further sensing arrangement 140 that preferably senses the trailing edge of a banknote and preferably can sense a double banknote condition. As a single banknote is passed between the rollers 116 and 118, the sensor 140 detects the trailing edge of the banknote. Once the trailing edge of the banknote has been sensed, motor 106 that drives rollers 114 and 116 is stopped. In this way, the individual banknote is fed on to the validating section 131 as the drive rollers 142, 144, 146 and 148 continue to be driven by motor 105. After a certain period of time, motor 106 is actuated for feeding of the next banknote to the validating section. This arrangement reduces the time duration motor 108 is in a stall condition.

As shown in FIG. 5, drive rollers 142, 144, 146 and 148 are interlinked by a gear train 150 where the motor 105 effectively chives gear 152. In this way, the speed of rollers 142, 144, 146 and 148 are maintained in synchronization. These rollers are also synchronized with the drive rollers 114 and 116 via the gear train 154. The gear train includes an overrunning clutch 156. This overrunning dutch 156 allows the gear train 154 to be effectively stopped while allowing gear train 150 to continue to drive rollers 142, 144, 146 and 148. In gear train 154, gear 158 is effectively driven by the motor 106.

Motor 106 is run at a slightly reduced speed relative to motor 105, however, the driver rollers 114 and 116 are kept synchronized with the drive rollers 142, 144, 146 and 148. Any slight speed difference between the motors is accommodated by the overrunning dutch 156. When gear 158 is effectively stopped by stopping motor 106, drive rollers 114 and 116 are stopped. As can be appreciated, 106 is stopped to allow separation between the banknotes being fed in series to the validating section 131. Motors 5 and 6 are reversible motors to allow the feeding of a banknote in the direction shown in FIGS. 5 and 6 as well as to allow the rejection of a banknote as shown in FIG. 7.

Figure 8:
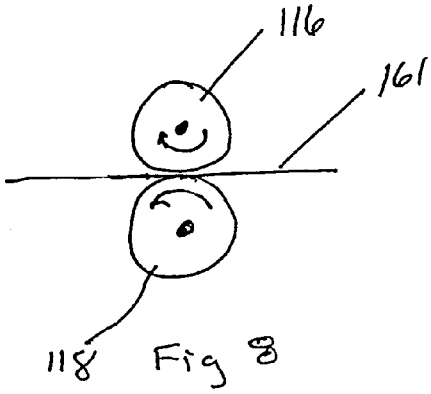
FIG. 8 is a schematic view of two drive rollers rotating to pass a single banknote.
Figure 9:
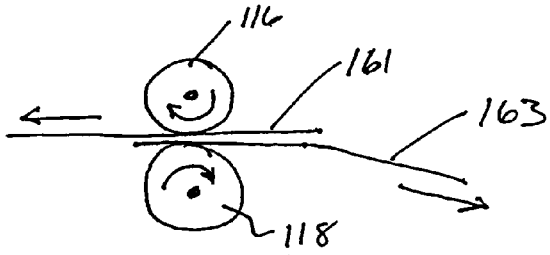
FIG. 9 shows the two rollers of FIG. 8 with one roller rotating in the opposite direction as a second banknote is attempting to be fed through the device.
Figure 11:
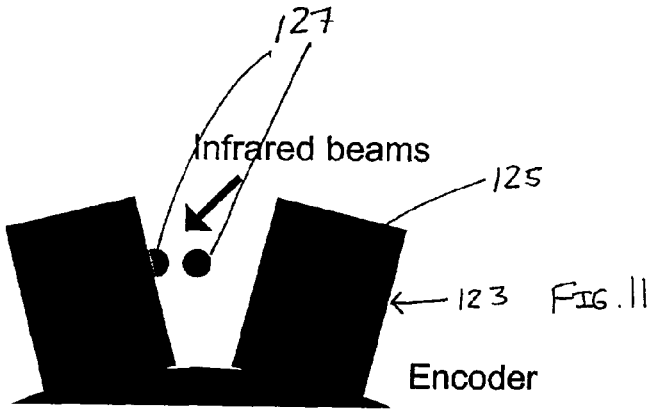
FIG. 11 illustrates a rotation sensor.

The principle which allows separation of the banknotes into a series of individual banknotes can be appreciated from a review of FIGS. 8, 9, and 11.

In FIG. 8, a single banknote 161 is shown passing between drive roller 116 and restricting drive roller 118. Even through drive roller 118 is having a torque applied thereto by motor 108 which would cause a clockwise rotation of the roller, the roller rotates counterclockwise as it is effectively overpowered by roller 116 and the frictional engagement with the banknote 161. When two banknotes attempt to pass between rollers 116 and 118 as shown in FIG. 9, the top banknote 161 is driven by roller 116 and will continue to be forced through the rollers to the validating section. The underlying banknote 163 will be urged to return to the banknote receiving cavity 102.

Basically the banknotes 161 and 163 have a low coefficient friction therebetween, and as such, roller 118 having a relatively high coefficient with banknote 163, is automatically free to rotate clockwise by the motor 105 and the banknote 163 will be returned to the banknote receiving cavity. Therefore the lower coefficient of friction between the banknotes is effectively used to provide slippage between banknotes and the forcing of the underlying banknote to return to the cavity due to its engagement with roller 118 that is now rotating clockwise due to the slippage between the banknotes. As soon as the banknote 163 is free of the gap between the rollers 116 and 118, roller 118 will rotate counterclockwise as shown in FIG. 8.

As can be appreciated, as soon as an additional banknote attempts to pass through the rollers, slippage between the banknotes occurs, and roller 118 will automatically rotate clockwise. This arrangement has proven particularly effective in avoiding the passing of two banknotes between rollers 116 and 118.

As shown in FIG. 4, rollers 116 and 118 are essentially two pairs of rollers provided across the banknote. Preferably, roller 114 is a single roller provided adjacent the center line of the banknote processing path.

Figure 10:
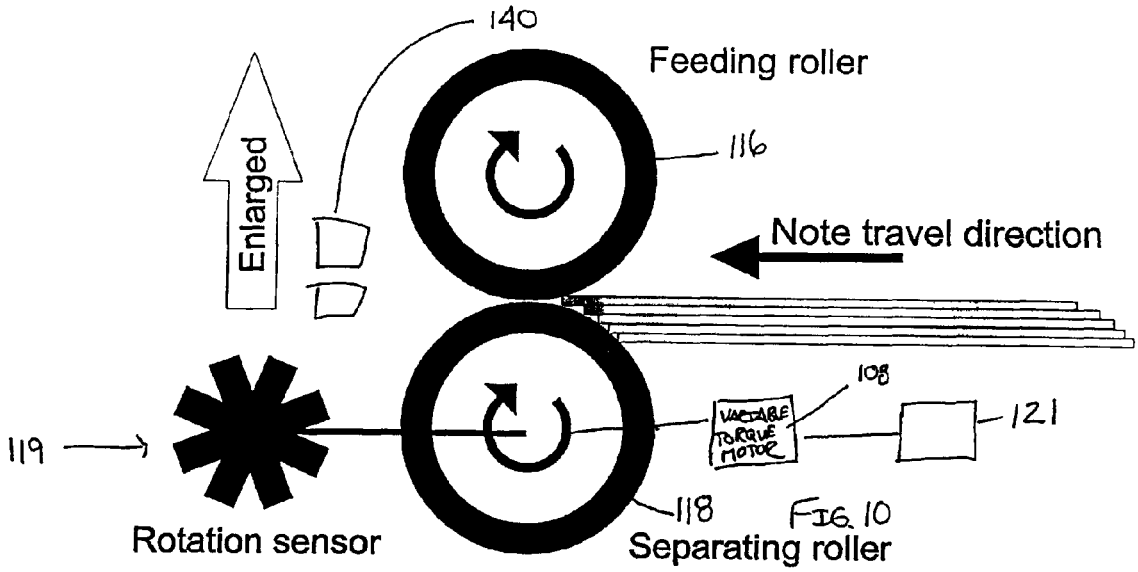
FIG. 10 illustrates a torque adjustment structure.

FIGS. 10 and 11 provide additional details regarding one embodiment for control of the variable torque motor 108. The condition of the banknotes and particularly the amount where the banknotes and the amount of dirt on the banknotes render it difficult to provide a single setting of the motor torque that will assure separation of the banknotes. The arrangement as shown in FIGS. 10 and 11 allow for adjustment of the motor torque through the controller 121.

As previously described, the feed roller 116 and the separating roller 118 cooperate to separate a double layer of banknotes passing between the rollers. In addition, the sensor 140 is capable of detecting a double banknote condition. As can be appreciated, if the coefficient of friction between two banknotes is high enough to overcome the torque being applied by the variable torque motor 108, then two banknotes will be processed.

With the sensor 140, detecting a double banknote condition, this signal is provided to the controller 121 which is able to adjust the torque of motor 108 until the sensor 140 no longer detects a double banknote condition. This increase is carried out as the double banknotes are being processed and the banknotes can be returned to the stacked condition if the separation is not successful.

To assist the system, the variable torque 108 includes a rotation sensor 119 associated with the separation roller 118. The rotation sensor 119 can be quite accurate and provides feedback with respect to the direction of rotation of roller 118. This is helpful in that when a double banknote condition is detected by 140 and the torque is being increased, the rotation sensor 119 can determine when the torque is sufficient to separate the banknotes.

The rotation sensor 119 is partially shown in FIG. 11 and includes a rotating member 123 with a series of spaced teeth 125 thereon which move past a series of infrared beams 127. This provides fast accurate feedback with respect to rotation direction.

In addition to monitoring for a double banknote condition during normal operation of the device, the arrangement is also used as part of a calibration process which is carried out periodically, for example, at power up of the device. The torque calibration process for setting the torque value is as follows: 1) With no bills in the device, feed roller 116 is driven in its normal manner. Variable torque motor 108 is set at a relatively low torque value and the rotation sensor is monitored to determine the direction of rotation of separation roller 118. If roller 118 is not rotating, then there is no requirement to change the torque. If roller 118 is rotating in sympathy with roller 116, then the torque is increased. The torque is increased until such time as there is no rotation of roller 118. Once the calibration has been completed, the particular torque is then reduced to an operating level of between 70 and 80%. This particular level has been found to be effective in separating of the banknotes. This calibration arrangement takes into account the working conditions of the separating arrangement and partially reflects the surface conditions of the rollers which can deteriorate due to dirt, etc.

It is also possible to operate the system in a slightly different manner. In this case, after the calibration and a determination of the torque necessary to hold roller 118 stationary when in contact with roller 116, controller 121 adjusts the variable torque motor 108 to a setting of approximately 20 to 30 percent of the calibrated torque. With this lower torque arrangement, the rollers 116 and 118 will allow the banknote to pass therebetween, but may allow two banknotes to pass therebetween. The sensor 140 then senses a double banknote condition. Once this condition is detected, the torque on motor 108 can be increased until such time as the rotation sensor 119 detects a reverse rotation. At that point, the torque can remain until the double banknote condition has been overcome.

From the above it can be appreciated that variations in operating procedures for adjusting the torque on the motor 108 are possible using the rotational sensor 119 for determining the direction of rotation of roller 118 in combination with the double banknote sensor 140.

A further feature of the validator 100 is the ability to access the first drive 106 and the banknote restricting drive 108. Access to this is provided by the access door 180 which is pivoted at 182 to swing upwardly. A latch 184 is provided at the free edge of the lid 180. Release of the latch 184 allows the drive rollers 114 and 116 to move upwardly with the lid. The drive gears can also move upwardly or being provided at the sides of the lid. This provides excellent access to the banknote receiving cavity for service of any of the components and/or clearing of anything lodged within the device. Similarly, the banknote validating section 131 can be accessed via the access door 186 pivoted at 188 and having the releasable latch 190. Release of latch 180 allows the access door 186 to move into the left about the pivot point 188 to provide access to the banknote processing path.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A banknote receiving arrangement comprising a banknote receiving cavity for receiving a stack of banknotes, said banknote receiving cavity being downwardly angled and merging with a curved transition segment connected to a banknote validating section, said curved transition segment receiving banknotes from said banknote receiving cavity and guiding banknotes at an angle upwardly towards an engagement point of a first drive arrangement and a restricting drive arrangement adjacent said banknote validating section; said first drive arrangement including a lead roller and a downstream roller with each roller engaging an exposed upper banknote of said stack of banknotes on an upper side of said banknote and driving the upper banknote through said transition segment into said banknote validating section, said restricting drive arrangement including a restricting roller in opposed relationship with said downstream roller of said first drive arrangement to limit the passage of banknotes therebetween to a single thickness of a banknote, said restricting drive arrangement including a motor providing a low torque rotating said restricting roller in a reverse direction urging a banknote to said receiving cavity when two banknotes attempt to pass between said downstream roller of said first drive arrangement and said restricting roller of said restricting drive arrangement; said downstream roller of said first drive arrangement being driven at a higher torque and providing sufficient force to the upper banknote to overpower the torque of said restricting roller of said banknote restricting drive arrangement and cause said restricting roller to rotate in a direction to pass said exposed upper banknote to said validating section when a single banknote is located between the downstream roller and the restricting roller; said banknote receiving arrangement further including a sensor arrangement for sensing insertion of a stack of banknotes into said banknote receiving cavity and causing movement of said lead roller from a position clear of the stack of banknotes to a position in engagement with the upper most banknote of the stack of banknotes and to cause said lead roller to drive the upper most banknote through said curved transition segment to said engagement point of said first drive arrangement and said restricting arrangement defined by said downstream roller and said restricting roller.

2. A banknote receiving arrangement as claimed in claim 1 wherein said downstream roller and said restricting, roller each have a coefficient of friction with a banknote higher than a coefficient of friction between two banknotes.

3. A banknote receiving arrangement as claimed in claim 1 wherein said transition segment narrows towards said engagement point of said first drive arrangement and said restricting drive arrangement.

4. A banknote receiving arrangement as claimed in claim 3 wherein said restricting roller is directly opposed to said downstream roller.

5. A banknote receiving arrangement as claimed in claim 1 including an actuator associated with said sensor arrangement for moving said lead roller to said clear position allowing insertion of the stack of banknotes into said banknote receiving cavity to a start position, said sensor arrangement sensing the position of said stack of banknotes in said start position and causing said actuator to move said lead roller to a banknote engage position.

6. A banknote receiving arrangement as claimed in claim 1 wherein two downstream rollers are provided and two restricting rollers are provided in opposed relation with said two downstream rollers.

7. A banknote receiving arrangement as claimed in claim 6 wherein said two downstream rollers and said two drive rollers each include an outer sleeve of a material having a high coefficient of friction with a banknote.

8. A banknote receiving arrangement as claimed in claim 5 wherein said lead roller is provided on a pivoting arm controlled by said actuator to move between the clear position and the banknote engage position.

9. A banknote receiving arrangement as claimed in claim 8 wherein said pivoting arm includes a spring bias urging said arm to the banknote engage position.

10. A banknote receiving arrangement as claimed in claim 9 including a trailing edge sensor at a discharge position of said banknote restricting drive for sensing the passing of a trailing edge of a banknote into said banknote validating section, said trailing edge sensor temporarily stopping said first drive arrangement and said restrictive drive arrangement when the passing of a trailing edge of a banknote is sensed by said trailing edge sensor.

11. A banknote receiving arrangement as claimed in claim 1 wherein said motor of said banknote restricting drive arrangement is a variable torque DC motor.

12. A banknote receiving arrangement as claimed in claim 11 including a control system adjusting the variable torque of said motor for specific operating conditions.

13. A banknote receiving arrangement as claimed in claim 12 wherein said control system includes a sensor for detecting overlapped banknotes downstream of said restricting drive arrangement and said control system increasing the variable torque of said motor to cause separation of said overlapped banknotes.

14. A banknote receiving arrangement as claimed in claim 13 wherein said control system includes a rotation direction sensor of said banknote restricting drive arrangement.

* * * * *